US009134687B1

(12) United States Patent
Reidhaar

(10) Patent No.: US 9,134,687 B1
(45) Date of Patent: Sep. 15, 2015

(54) WASTE TONER BOTTLE FOR UNIFORM DISTRIBUTION OF RESIDUAL TONER FROM AN IMAGE FORMING DEVICE

(71) Applicant: Lexmark International, Inc., Lexington, KY (US)

(72) Inventor: Glen Alan Reidhaar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/217,755

(22) Filed: Mar. 18, 2014

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,466,763 | B1 | 10/2002 | Campbell et al. | |
| 6,546,225 | B2 | 4/2003 | Wang | |
| 7,167,672 | B2 | 1/2007 | Stafford et al. | |
| 7,280,776 | B2 | 10/2007 | Cook et al. | |
| 8,233,834 | B2 | 7/2012 | Horrall et al. | |
| 8,315,548 | B2 | 11/2012 | Gayne et al. | |
| 2005/0058475 | A1 * | 3/2005 | Tsurusaki | 399/358 |

* cited by examiner

*Primary Examiner* — Clayton E Laballe
*Assistant Examiner* — Jas Sanghera
(74) *Attorney, Agent, or Firm* — Justin M Tromp

(57) ABSTRACT

A waste toner bottle for an imaging device according to one example embodiment includes a housing having a reservoir for storing toner. A tube defines an auger path about the housing. The tube is in fluid communication with a plurality of inlets of the housing and has a transfer auger disposed along the auger path to move toner into the reservoir. The tube extends upward into the upper region of the housing above the plurality of inlets. The tube extends from a first end of the reservoir to a second end of the reservoir in the upper region of the housing. The tube includes perforations in a bottom of the tube between the first end of the reservoir and the second end of the reservoir in the upper region of the housing to drop toner from the auger path into the reservoir.

22 Claims, 8 Drawing Sheets

WASTE TONER BOTTLE FOR UNIFORM DISTRIBUTION OF RESIDUAL TONER FROM AN IMAGE FORMING DEVICE

CROSS REFERENCES TO RELATED APPLICATIONS

None.

BACKGROUND

1. Field of the Invention

The present invention relates generally to an image forming device and more particularly to a waste toner bottle for the image forming device.

2. Description of the Related Art

Image forming devices such as printers, copiers, facsimile machines, and the like, produce unusable "waste" or residual toner as a byproduct of an electrophotographic (EP) process. Ideally, all toner that is picked up by a photoconductive (PC) drum, such as from a developer roll in a single component development system or from a magnetic roll in a dual component development system, would be transferred onto a media sheet in a one-step toner transfer process or, prior to the media sheet, onto an intermediate transfer member (ITM) in a two-step toner transfer process. However, due to inefficiencies, some of the toner picked up by the PC drum does not get transferred to the media sheet or ITM. This residual toner left on the PC drum after it has contacted the media sheet or ITM must be removed before the next image is formed otherwise print defects may occur. A cleaner blade or a cleaner brush is typically placed in contact with the PC drum to wipe and remove residual toner from its surface. Residual toner is then delivered to and stored in a sealed waste toner bottle to prevent the residual toner from being distributed inside the image forming device. A similar cleaning operation may be performed on the developer (or magnetic) roll and the ITM.

It is customary for toner to flow into a waste toner bottle from one or more inlets in an uppermost portion of the waste toner bottle and then for a mechanism, such as an auger or rake, to crest the top of the resulting pile(s) of toner in the bottle to make it uniform. For example, FIG. 1 shows a waste toner bottle 100 having inlets 102A, 102B, 102C, 102D and 102E in an uppermost portion 103 of the bottle 100 and a horizontal auger 104 beneath the inlets 102. The toner 106 naturally falls to the bottom of bottle 100 due to gravity and then fills it from bottom to top until reaching the auger 104. Once the pile gets near the top of the bottle 100, the auger 104 crests the pile, making the top flat, by pushing the toner 106 over the edge of the pile where again gravity causes it to fall downward.

However, sometimes the architecture of the image forming device prevents toner from entering at the uppermost portion of the waste toner bottle. Further, in color EP image forming devices, multiple inlets may be required for each of the different color toners. Different customers will print different content. For example, some customers print all black text, others print multi-colored photos, and other may print just one color. As a result, the amount of toner entering each inlet of the waste toner bottle may be unpredictable, making it difficult to evenly distribute toner in the waste toner bottle. Accordingly, a waste toner bottle that provides uniform distribution of waste toner is desired.

SUMMARY OF THE INVENTION

A waste toner bottle for an imaging device according to one example embodiment includes a housing having a reservoir for storing toner. The housing has an upper region and a plurality of inlets to receive toner from the imaging device. A tube defines an auger path disposed about the housing. The tube is in fluid communication with the plurality of inlets and has a transfer auger disposed along the auger path to move the toner received from the imaging device into the reservoir. The tube extends upward into the upper region of the housing above the plurality of inlets to move the toner received from the imaging device into the upper region of the housing. The tube extends from a first end of the reservoir to a second end of the reservoir in the upper region of the housing. The tube includes perforations in a bottom of the tube between the first end of the reservoir and the second end of the reservoir in the upper region of the housing to drop toner from the auger path into the reservoir.

A waste toner bottle for an imaging device according to another example embodiment includes a housing having a reservoir for storing toner. The housing has an upper region and a plurality of inlets to receive toner from the imaging device. A first tube defines a first auger path disposed about the housing. The first tube is in fluid communication with the plurality of inlets and has a first transfer auger disposed along the first auger path to move toner received from the plurality of inlets to an outlet of the first tube. A second tube has an inlet disposed below the outlet of the first tube and in fluid communication therewith for receiving toner from the first tube via gravity. The second tube has a second auger path about the housing and a second transfer auger disposed along the second auger path to move the toner received from the first tube into the reservoir. The second tube extends upward into the upper region of the housing above the plurality of inlets to move the toner received from the first tube into the upper region of the housing. The second tube extends from a first end of the reservoir to a second end of the reservoir in the upper region of the housing. The second tube includes perforations in a bottom of the second tube between the first end of the reservoir and the second end of the reservoir in the upper region of the housing to drop toner from the second auger path into the reservoir.

A method for evenly distributing toner in a waste toner bottle of an imaging device according to one example embodiment includes receiving toner from a plurality of inlets. The received toner is directed to an auger. The directed toner moves upward to an upper region of a housing of the waste toner bottle above the plurality of inlets. The toner drops by gravity from the auger in the upper region of the housing into a reservoir of the waste toner bottle beginning at a first end of the reservoir and extending to a second end of the reservoir to fill the reservoir with toner from the first end to the second end.

A method for evenly distributing toner in a waste toner bottle of an imaging device according to another example embodiment includes receiving toner from a plurality of inlets. The received toner is directed to a first auger tube. The directed toner transfers by gravity from an outlet of the first auger tube to an inlet of a second auger tube. The transferred toner moves in the second auger tube upward to an upper region of a housing of the waste toner bottle above the plurality of inlets. The toner drops by gravity from the second auger tube in the upper region of the housing into a reservoir of the waste toner bottle beginning at a first end of the reservoir and extending to a second end of the reservoir to fill the reservoir with toner from the first end to the second end.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
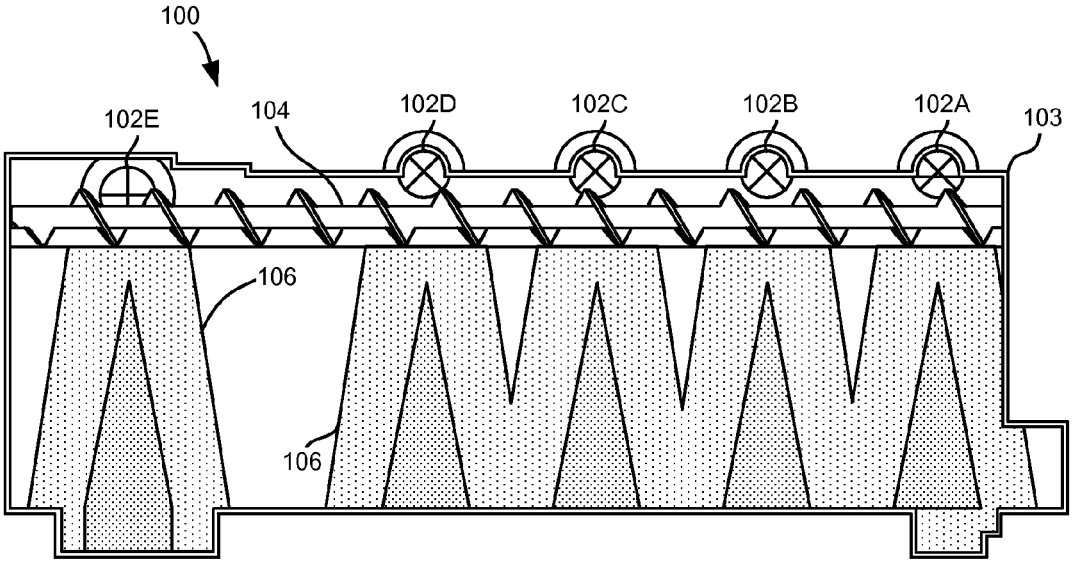
FIGURE 1 (PRIOR ART)
FIG. 1 is a side cross-sectional view of a prior art waste toner bottle having a residual toner delivery mechanism.
Figure 2:
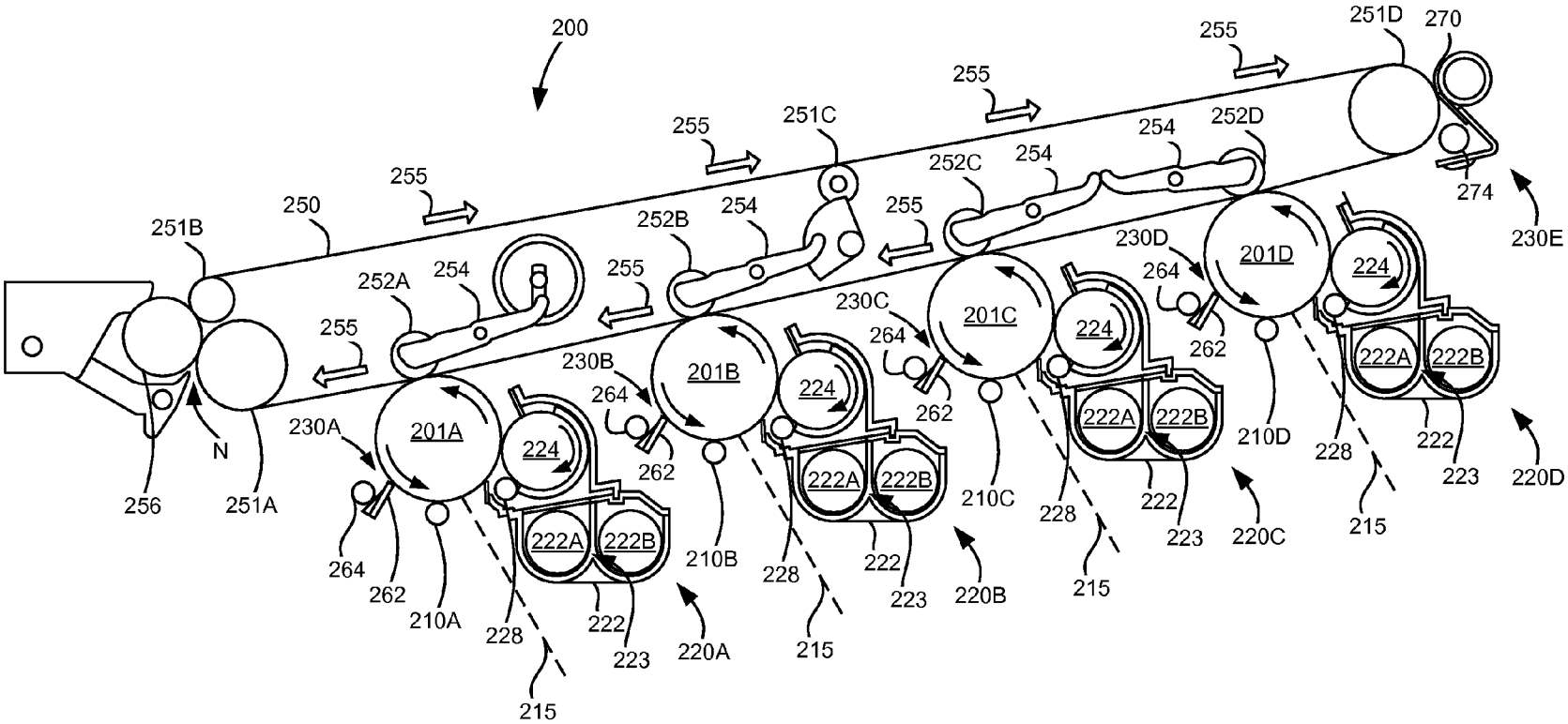
FIG. 2 is a schematic view of an imaging system of an image forming device according to one example embodiment.

FIG. 2 illustrates a side cross-sectional view of an example imaging system 200 of a color electrophotographic image forming device. The imaging system 200 includes photoconductive drums 201A, 201B, 201C, 201D, charge rolls 210A, 210B, 210C, 210D, developer units 220A, 220B, 220C, 220D, and cleaner units 230A, 230B, 230C, 230D for removing residual or waste toner from the photoconductive drums 201. Photoconductive drums 201A, 201B, 201C and 201D as well as the developer units 220A, 220B, 220C and 220D and cleaner units 230A, 230B, 230C and 230D may each be substantially the same except for the color of toner contained therein (e.g., cyan, yellow, magenta and black colored toner, respectively). The electrophotographic printing process is well known in the art and, therefore, is described briefly herein. During a print operation, the charge rolls 210 charge the outer surface of each corresponding photoconductive drum 201. The charged surface of photoconductive drum 201 is then selectively exposed to a laser light 215 from a laser light source to form an electrostatic latent image on photoconductive drum 201 corresponding to the image being printed. Charged toner from each developer unit 220 is picked up by the latent image on the corresponding photoconductive drum 201, creating a toned image thereon.

The example image forming device shown utilizes what is commonly referred to as a dual component development system. In this embodiment, each developer unit 220 includes a housing 222 having a toner chamber 223 in which toner is mixed with magnetic carrier beads. The magnetic carrier beads may be coated with a polymeric film to provide triboelectric properties to attract toner to the carrier beads. Each developer unit 220 further includes a magnetic roll 224 that attracts the magnetic carrier beads through the use of magnetic fields and transports the toner on it to the corresponding photoconductive drum 201. In this embodiment, augers 222A and 222B are disposed in the housing 222 and are used to mix toner and carrier beads by moving them in opposite directions along the length of each developer unit 220 (into and out of the page as viewed in FIG. 2). It is understood that developer unit 220 may utilize other mechanisms for suitably mixing the toner and carrier beads. A trim bar 228 disposed along magnetic roll 224 provides a substantially uniform layer of toner on magnetic roll 224 for the subsequent transfer to photoconductive drum 201. As photoconductive drum 201 and magnetic roll 224 rotate, electrostatic forces from the latent image on photoconductive drum 201 strip the toner from the magnetic carrier beads on magnetic roll 224 to provide the toned image on the surface of photoconductive drum 201. Magnetic roll 224 then magnetically releases the toner and carrier beads back to the toner chamber 223.

In other embodiments, the image forming device utilizes a single component development system. In these embodiments, a developer roll in each developer unit 220 supplies the toner particles from the toner chamber onto the corresponding photoconductive drum 201. A doctor blade disposed along the developer roll provides a substantially uniform layer of toner on the developer roll for the subsequent transfer to photoconductive drum 201. A toner adder roll may supply toner from the toner chamber to the developer roll. Further, one or more agitators can be provided in the toner chamber to distribute toner therein and to break up any clumped toner.

The toned image is transferred from photoconductive drums 201A, 201B, 201C, 201D to print media (e.g., paper) either directly by photoconductive drums 201A, 201B, 201C, 201D or indirectly by an intermediate transfer member (ITM) 250 as shown. The ITM 250 is mounted on ITM rolls 251A, 251B, 251C and 251D as well as backup rolls 252A, 252B, 252C and 252D opposed to photoconductive drums 201A, 201B, 201C and 201D, respectively. The backup rolls 252 are mounted on arms 254 to freely rotate ITM 250 (in the direction of arrows 255) along each photoconductive drum 201, which rotate in a counterclockwise direction as shown. A multi-color toned image on ITM 250 is transferred to the print media as it passes through a nip region N formed between the ITM roll 251A and a roll 256 adjacent ITM 250. Thereafter, a fusing unit (not shown) fuses the toner to the print media. A cleaning blade 262 (or roll) of each cleaner unit 230 removes any residual toner adhering to corresponding photoconductive drum 201 after the toner is transferred to ITM 250. Residual toner from cleaning blade 262 is directed to an auger 264 of cleaner unit 230 for transporting residual toner to a waste toner bottle 266 (shown in the succeeding Figures). The cleaned surface of photoconductive drum 201 is then ready to be charged again and exposed to corresponding laser light 215 to continue the printing cycle. A cleaner blade 270 (or cleaning roll) of a cleaner unit 230E removes any residual toner adhering to ITM 250 and an auger 274 of the cleaner unit 230E transports the residual toner to the waste toner bottle 266.

Components of imaging system 200 are replaceable as desired. For example, in one embodiment, developer units 220 may be housed in a replaceable unit with photoconductive drums 201, one or more cleaner units 230 and a main toner supply of the image forming device. In another embodiment, developer units 220 are provided with photoconductive drums 201 and the one or more cleaner units 230 in a first replaceable unit while the main toner supply of the image forming device is housed in a second replaceable unit. Further, any other combination of replaceable units can be used as desired.

Figure 3:
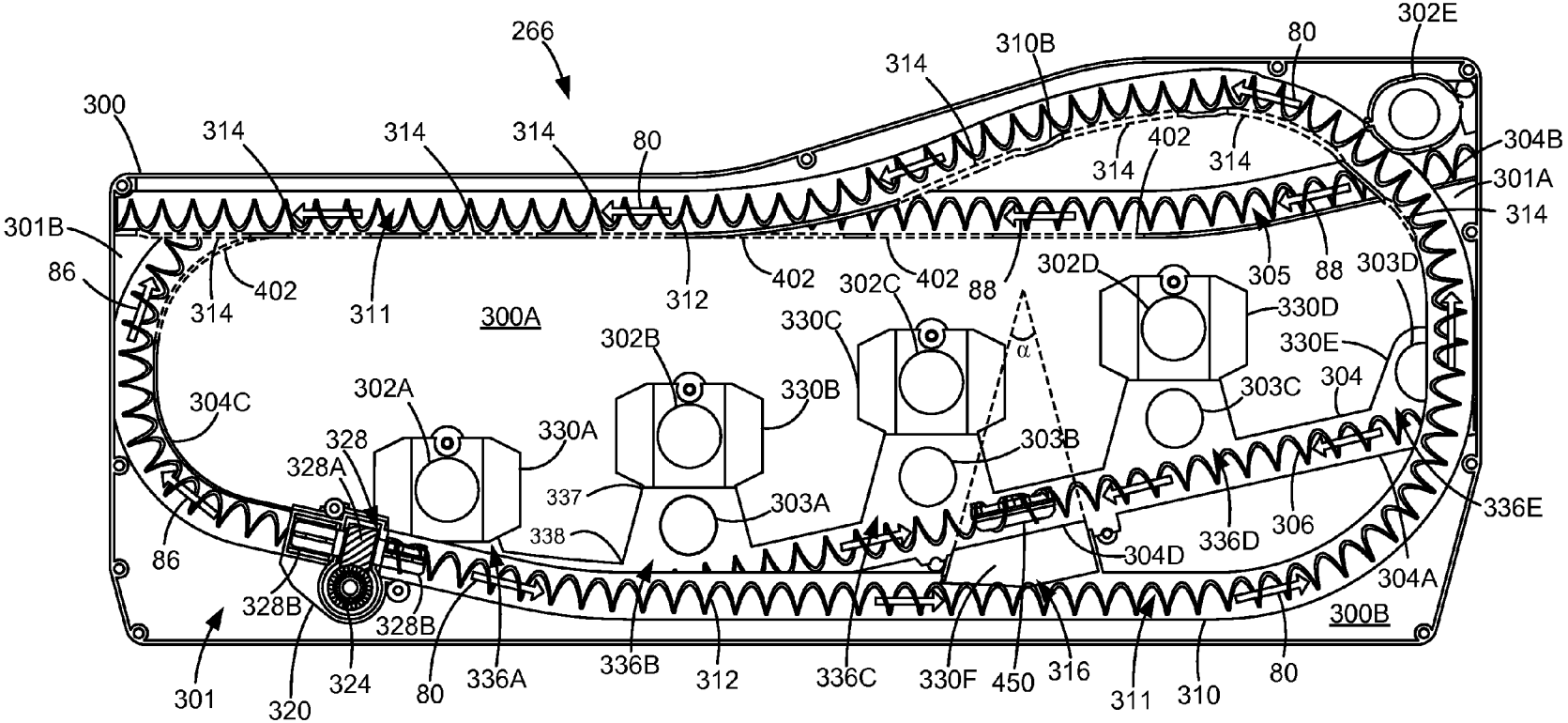
FIG. 3 is a side cross-sectional view of a waste toner bottle of the image forming device of FIG. 2 having a residual toner delivery mechanism according to one example embodiment.
Figure 4:
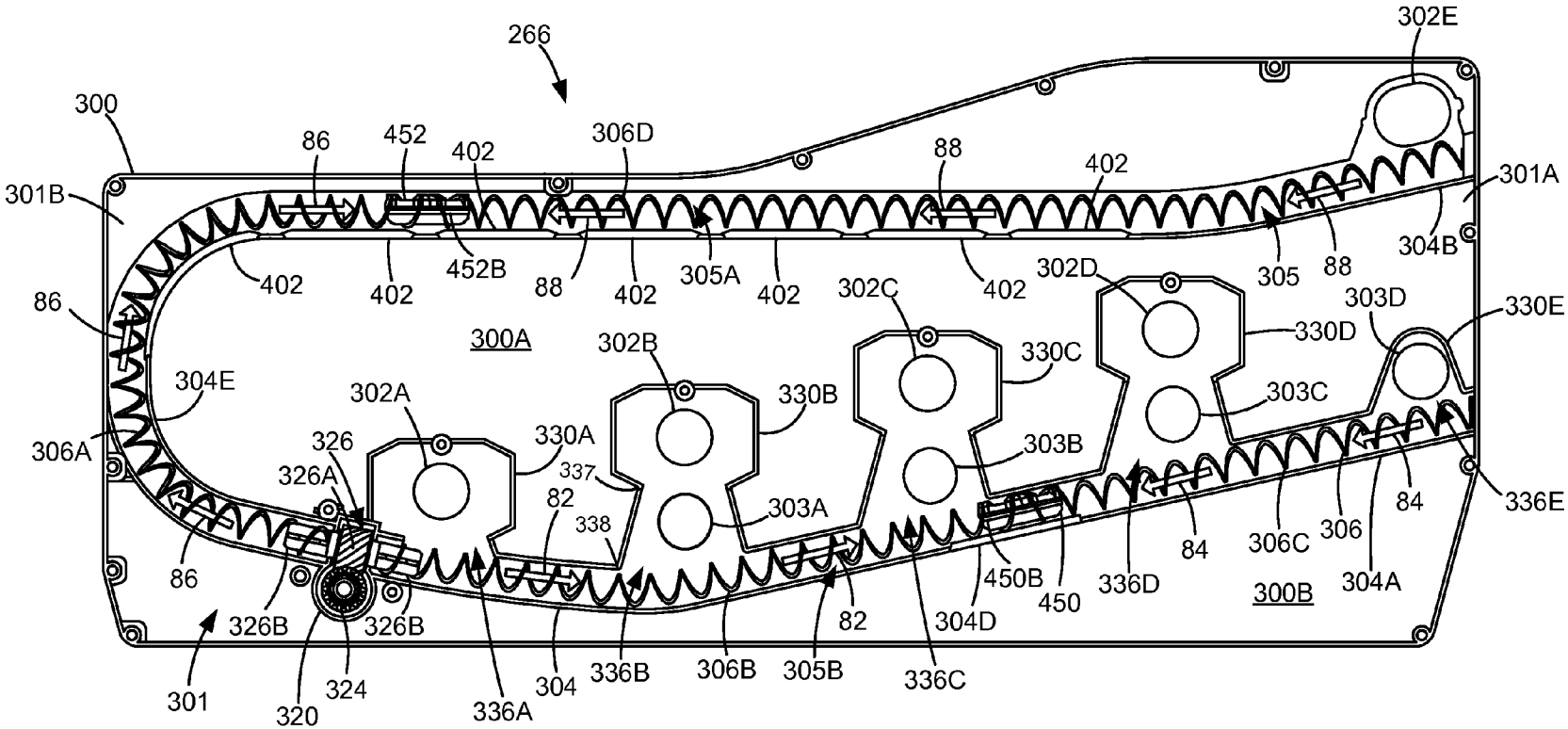
FIG. 4 is a side cross-sectional view of the waste toner bottle of FIG. 3 with an auger tube removed to more clearly show a portion of the residual toner delivery mechanism.

FIGS. 3 and 4 illustrate a side cross-sectional view of waste toner bottle 266 employing a residual toner delivery mechanism for maximizing the amount of residual toner that can be stored. Waste toner bottle 266 includes a housing 300 having a reservoir 301 for storing the residual toner and the waste carrier beads where a dual component development system is used. In the embodiment illustrated, the housing 300 is a long, hollow container having a height less than the length and a width less than the height. In the example embodiment illustrated, a first height of housing 300 at a right end 301A of the reservoir 301 (sliding down toward a center of housing 300) is greater than a second height of housing 300 formed from the center thereof to a left end 301B of reservoir 301. Housing 300 includes an upper region 300A and a lower region 300B as well as toner inlets 302A, 302B, 302C, 302D, and carrier bead inlets 303A, 303B, 303C, 303D, where a dual component development system is used, disposed in reservoir 301. A line connecting corresponding toner inlets 302A, 302B, 302C, 302D and another line connecting corresponding carrier bead inlets 303A, 303B, 303C, 303D form a first and a second upward incline, respectively, spaced apart from and substantially parallel to each other. A toner inlet 302E is disposed in reservoir 301 at its right end 301A, near the top of housing 300 at its first height. Toner inlets 302 and carrier bead inlets 303 are through holes in the side of housing 300 for residual toner and waste carrier beads, respectively, to enter reservoir 301.

Waste toner bottle 266 includes auger tubes 304 and 310 that run next to each other about housing 300, extending along the length thereof and at least part of the height thereof. FIG. 4 shows waste toner bottle 266 with auger tube 310 removed in order to more clearly illustrate the features of auger tube 304. As shown in FIG. 4, the auger tube 304 is disposed within reservoir 301 and is adjacent to and positioned directly below toner inlets 302 and carrier bead inlets 303. Auger tube 304 has a lower right region 304A along a path substantially parallel to the first and second upward inclines for receiving residual toner and waste carrier beads from toner inlets 302B, 302C, 302D and carrier bead inlets 303A, 303B, 303C, 303D along the substantially parallel path. In particular, auger tube 304 forms a U-shape that spans the entire length of housing 300, starting from right end 301A, below carrier bead inlet 303D, moving along the substantially parallel path, and looping in a clockwise direction (as viewed in FIG. 4) from a position below carrier bead inlet 303A, passing through a drive assembly 320 positioned below toner inlet 302A. As auger tube 304 reaches the top of housing 300 at its second height near left end 301B, auger tube 304 runs substantially horizontal toward right end 301A to terminate below the toner inlet 302E and thereby enclose toner inlets 302A, 302B, 302C, 302D and carrier bead inlets 303A, 303B, 303C, 303D inside the U-shape.

Returning to FIG. 3, the auger tube 310 is also disposed within reservoir 301, forming another U-shape that spans the entire length and height of housing 300. The U-shape of auger tube 310 starts at the drive assembly 320 and then runs horizontally along bottom region 300B toward right end 301A. Thereafter, auger tube 310 loops toward upper region 300A in a counterclockwise direction (as viewed in FIG. 3) and runs horizontally toward the left end 301B upon reaching the center of housing 300. Auger tube 310 terminates at left end 301B of reservoir 301, thereby enclosing toner inlets 302A, 302B, 302C, 302D and carrier bead inlets 303A, 303B, 303C, 303D inside its U-shape.

Auger tubes 304 and 310 are hollow tubes that define auger paths 305 and 311, respectively, to provide a path for residual toner and waste carrier beads to move about housing 300. Auger tube 304 includes an outlet 304D for the residual toner and waste carrier beads to exit auger tube 304 into auger tube 310 in bottom region 300B. As shown in FIG. 4, the auger path 305 includes two auger path segments 305A, 305B, respectively, each coupled to opposite ends of the drive assembly 320 and separated thereby. Auger tubes 304, 310 include wire augers 306, 312 disposed along auger paths 305, 311, respectively, to transport residual toner and waste carrier beads about housing 300. The wire augers 306, 312 are flexible for looping around the U-shapes of auger tubes 304, 310, respectively. In one embodiment, wire augers 306, 312 are flat wire augers.

With reference to FIGS. 3 and 4, in one embodiment, the entire wire auger 312 is a single wire auger segment driven in one direction along the continuous auger path 311. Drive assembly 320 includes a drive member 326 (FIG. 4) coupled to opposed ends of wire auger 306 and a drive member 328 (FIG. 3) coupled to one end of wire auger 312 to provide rotational power for transporting toner and carrier beads. The drive members 326, 328 can be driven by any drive mechanism, such as a rotating member 324, or a translating member (not shown) moving into and out of the page. Rotating member 324 is coupled to drive members 326, 328 using gears 326A, 328A that are mounted thereon, respectively, and receives the rotational power directly or indirectly from a motor (not shown) to rotate the gears 326A, 328A. As drive members 326, 328 rotate, wire augers 306, 312 receive rotational power therefrom and thereby transport toner and carrier beads. Drive members 326, 328 have a cross-section defined by a plurality of ribs 326B, 328B, respectively, and by an elongated shape for mounting wire augers 306, 312 at respective ends of drive members 326, 328. The ribs 326B, 328B extend radially from a longitudinal axis of drive members 326, 328 and also axially outward from gears 326A, 326B mounted at the center of respective elongated shapes of drive members 326, 328. In one example embodiment, gears 326A, 328A are helical gears to minimize noise and reduce the required power produced by the motor.

As shown in FIG. 4, wire auger 306 includes a plurality of segments such as wire auger segments 306A, 306B, 306C and 306D that each has at least one end coupled to a respective auger connector 450, 452. The connectors 450, 452 have the same features as drive members 326, 328 except that connectors 450, 452 do not have a gear. The auger segments may be connected to auger connectors 450, 452 such that as auger connectors 450, 452 rotate, an auger segment coupled to one end of the connector 450, 452 conveys toner and carrier beads in one direction and an auger segment coupled to the opposite end of the same connector 450, 452 conveys toner and carrier beads in the opposite direction due to one of the auger segments being wound in a right-hand orientation and the other being wound in a left-hand orientation. Connectors 450, 452 each have an elongated shape having a cross-section defined by a plurality of ribs 450B, 452B, respectively, extending radially from their longitudinal axes for engaging the auger segments.

Connectors 450, 452 for the wire augers 306A, 306B, 306C and 306D are disposed in lower region 300B along the auger path 305B and in upper region 300A along the auger path 305A, respectively. In this embodiment, connector 452 is disposed above toner inlet 302A and connector 450 is between carrier bead inlet 303B and carrier bead inlet 303C at a portion of the lower right region 304A of auger tube 304. Along auger path 305A, one end of wire auger 306A is rotatably coupled to ribs 326B of drive member 326 opposed to wire auger 306B. The opposite end of wire auger 306A is coupled to ribs 452B of connector 452, while wire auger 306D is coupled to the opposed ribs 452B and extends opposite wire auger 306A. Along auger path 305B, one end of wire auger 306B is rotatably coupled to the ribs 326B of drive member 326 opposite wire auger 306A. The opposite end of wire auger 306B is coupled to the ribs 450B of connector 450, while wire auger 306C is coupled to the opposed ribs 450B and extends opposite wire auger 306B. As such, residual toner and waste carrier beads along auger path 305B are moved from right end 301A by auger segment 306C and from the center of housing 300 by auger segment 306B toward the outlet 304D disposed therebetween.

Waste toner bottle 266 also includes chambers 330A, 330B, 330C, 330D, 330E that enclose corresponding inlets 302A, 302B, 302C, 302D, 303A, 303B, 303C, 303D and drop the toner and carrier beads via gravity into auger tube 304. Toner inlets 302A, 302B, 302C and 302D are in fluid communication with auger tube 304 through the chambers 330A, 330B, 330C and 330D, respectively, and carrier bead inlets 303A, 303B, 303C and 303D are in fluid communication with auger tube 304 through chambers 330B, 330C, 330D and 330E, respectively. Each chamber 330 is designed so that entering residual toner and carrier beads are immediately carried out of chamber 330, thereby remaining substantially empty. This prevents toner and carrier beads from accumulating near the corresponding inlets 302A, 302B, 302C, 302D, 303A, 303B, 303C, 303D and thereby prevents leakage out of housing 300 through inlets 302A, 302B, 302C, 302D, 303A, 303B, 303C, 303D. Leakage can also be prevented using a shutter and/or seal (e.g., foam) at each inlet 302A, 302B, 302C, 302D, 303A, 303B, 303C, 303D. In one embodiment, chambers 330 are isolation chambers that each has a larger opening at its outlet 336 than its enclosure of corresponding toner inlet 302 or its enclosure of carrier bead inlet 303D. Specifically, in this embodiment, an upstream opening 337 of outlet 336 is smaller than a downstream opening 338 of outlet 336. In another embodiment, an angle formed from the top portion of toner inlet 302 (or carrier bead inlet 303D) onto opposite ends of the outlet 336 is at least about 30 degrees, which prevents residual toner and/or carrier beads from clogging without use of any additional moving parts.

As shown in FIG. 3, a chamber 330F also encloses outlet 304D to drop the toner and carrier beads via gravity into an inlet 316 of auger tube 310. The inlet 316 is disposed below and is in fluid communication with the chamber 330F to transfer moving toner and carrier beads from auger tube 304 to auger tube 310 via gravity. With outlet 304D disposed below connector 450, the moving toner and carrier beads are directed to chamber 330F and thereby exit from auger tube 304 into inlet 316. In one embodiment, an angle $\alpha$ formed between extensions of opposed sides of the chamber 330F that intersect (shown as dashed lines) can be about 30 degrees to prevent falling toner and carrier beads from outlet 304D from clogging up auger tube 310 at inlet 316.

Auger tube 310 includes a plurality of perforations 314 along a bottom surface 310B of auger tube 310 in upper region 300A. The perforations 314 start from right end 301A, extend through the horizontal run of auger tube 310 at upper region 300A, and terminate at left end 301B. Perforations 314 are sized to allow moving toner and carrier beads to exit from auger tube 310 into reservoir 301. Auger tube 304 also includes a plurality of perforations 402 along its bottom surface 304B in upper region 300A. In particular, the perforations 402 start at a position above and substantially adjacent to toner inlet 302D and extend toward left end 301A along the substantially horizontal run of auger tube 310. Perforations 402 are also sized to allow moving toner to exit from auger tube 304 via gravity into reservoir 301, starting from the position above toner inlet 302D towards left end 301A.

In operating waste toner bottle 266, toner and carrier bead inlets 302, 303 receive residual toner and waste carrier beads, respectively, from the image forming device. In particular, residual toner transported from photoconductive drums 201A, 201B, 201C and 201D enters housing 300 through toner inlets 302A, 302B, 302C and 302D, respectively, using the augers 264 of corresponding cleaner units 230 while waste carrier beads from developer units 220A, 220B, 220C and 220D enter housing 300 through carrier bead inlets 303A, 303B, 303C and 303D, respectively, using waste delivery means. As shown in FIG. 4, as toner and/or carrier beads fall from the corresponding chambers 330 to auger path 305B of auger tube 304, its driven wire auger 306 moves the toner and carrier beads toward outlet 304D. In particular, wire auger 306B moves toner and carrier beads falling along its length (from chambers 330A, 330B and 330C) at a downward and then an upward incline toward connector 450 as indicated by arrows 82. At the same time, wire auger 306C moves toner and carrier beads falling along its length (from chambers 330D and 330E) at a downward incline toward connector 450 as indicated by arrows 84. With connector 450 disposed above outlet 304D, wire augers 306B and 306C simultaneously move the toner and carrier beads to outlet 304D. Toner and carrier beads from toner inlets 302A, 302B, 302C, 302D and carrier bead inlets 303A, 303B, 303C, 303D, respectively, are thus directed to fall into auger tube 310 via its inlet 316 as shown in FIG. 3. Wire auger 306A moves toner upwardly in a clockwise direction as viewed in FIGS. 3 and 4, as indicated by arrows 86, away from drive member 326 so that the rotation of drive member 326 is not impeded by toner.

In FIG. 3, once toner and carrier beads fall along driven wire auger 312 at inlet 316 (from chamber 330F), wire auger 312 moves toner and carrier beads upwardly in a counterclockwise direction as viewed in FIG. 3 and as indicated by arrows 80. When wire auger 312 moves toner and carrier beads vertically upward along auger path 311 near right end 301A, toner tends to fill auger tube 310. The horizontal run of auger tube 310 at lower region 300B approaching the point where toner is carried upward (in a counterclockwise direction as viewed in FIG. 3) prevents auger 310 from clogging with toner. As wire auger 312 moves toner and carrier beads upward, the toner and carrier beads reach perforations 314 and fall into reservoir 301 from right end 301A to left end 301B. Meanwhile, driven wire auger 306D of auger tube 304 moves toner received from toner inlet 302E along auger path 305A toward left end 301B (as indicated by arrows 88) to also fall into reservoir 301 through perforations 402 in the same manner. This redistributes residual toner and waste carrier beads evenly within reservoir 301.

Figure 5:
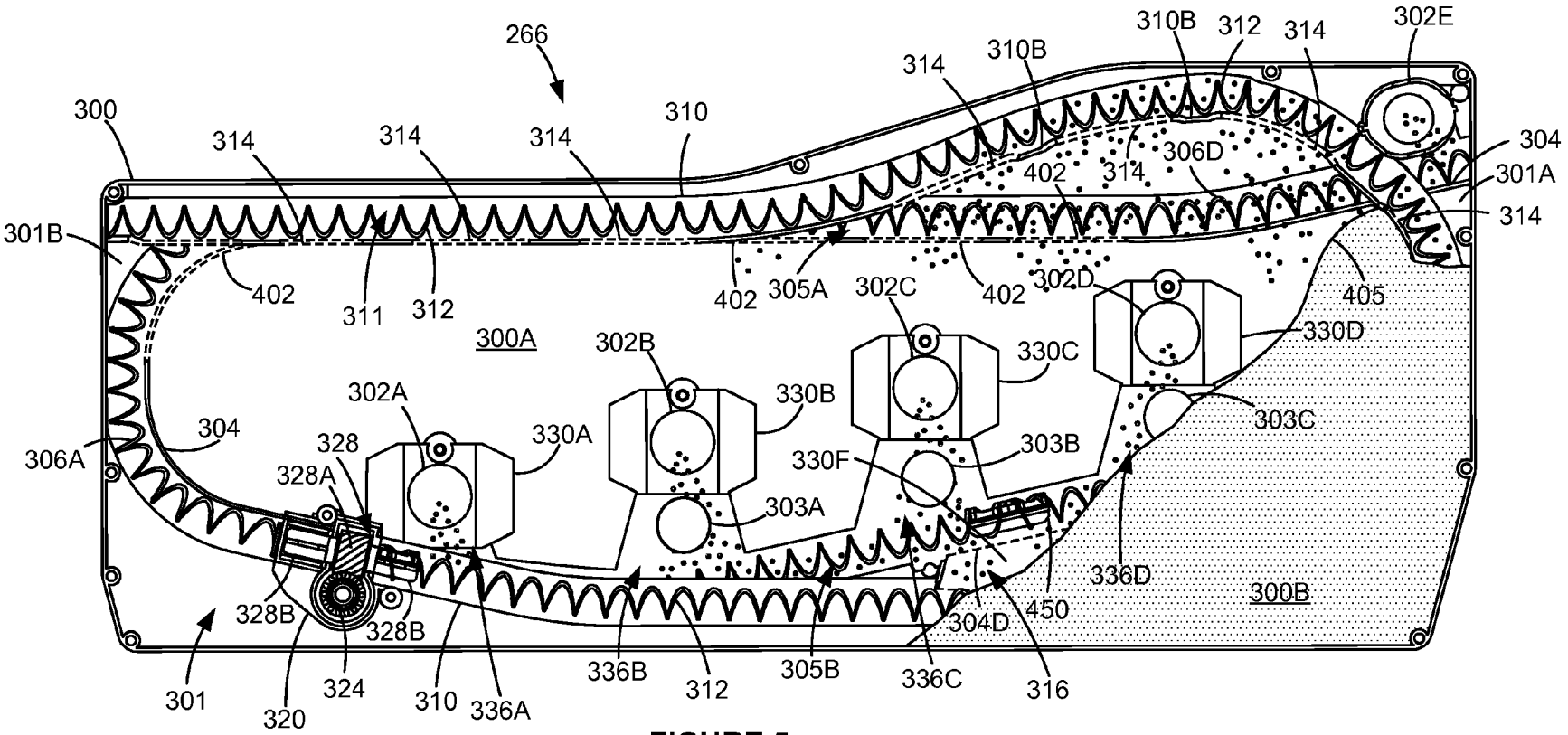
FIGS. 5-7 are sequential views of the distribution of residual toner and waste carrier beads within the waste toner bottle of FIGS. 3 and 4.
Figure 6:
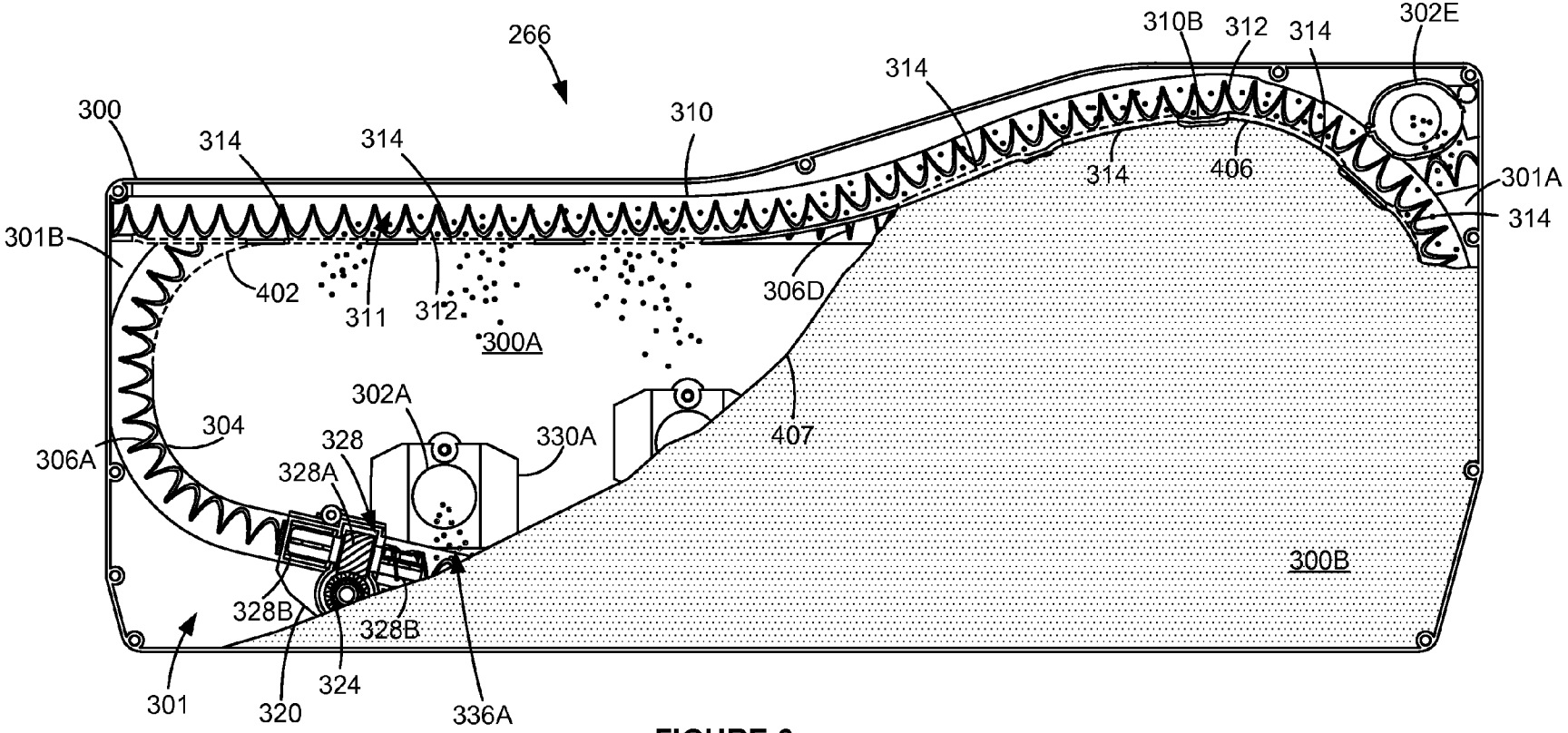
Figure 7:
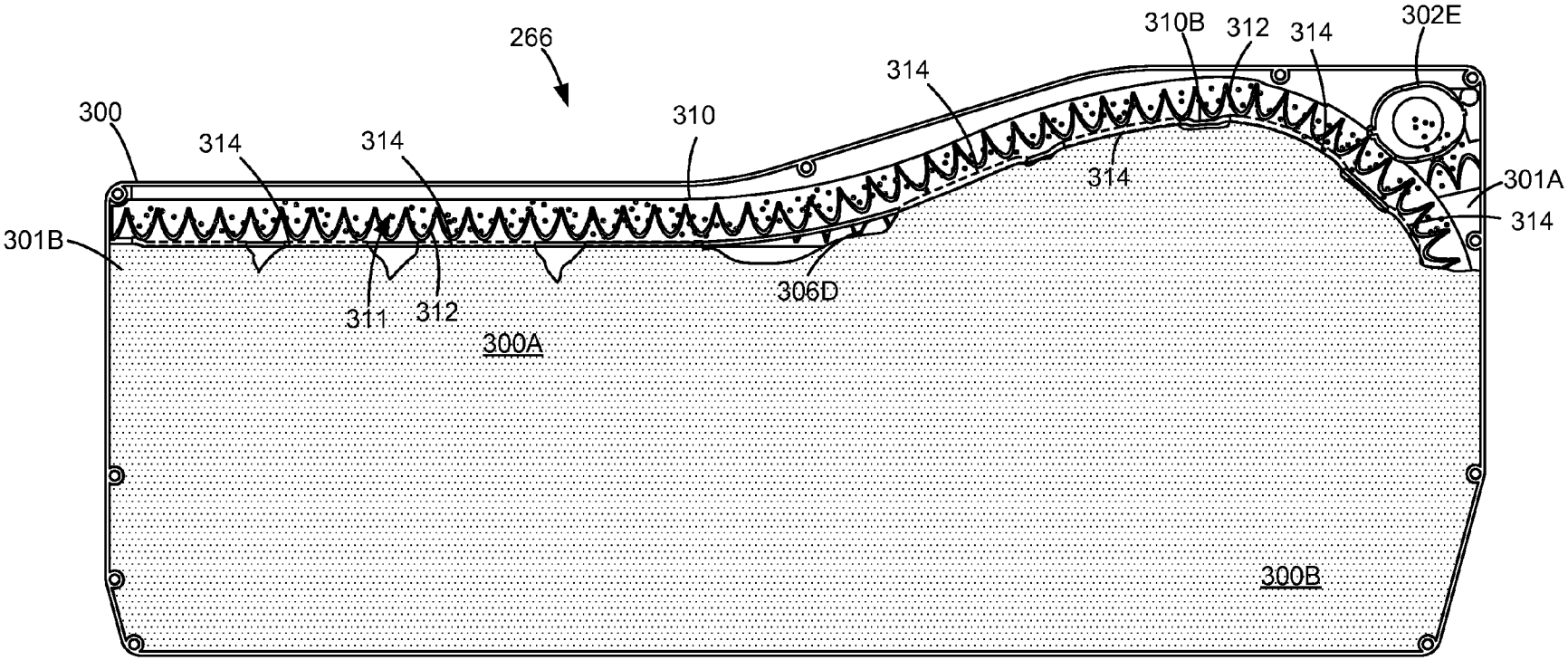

FIGS. 5-7 illustrate sequential views of the redistribution of residual toner and waste carrier beads within reservoir 301 using the residual toner delivery mechanism of FIG. 3. As each of the auger segments of wire auger 306 are driven, toner and carrier beads falling from corresponding chambers 330A, 330B, 330C, 330D, 330E are moved along auger path 305B of auger tube 304 toward its outlet 304D. The toner and carrier beads then fall from outlet 304D of auger tube 304 into inlet 316 of auger tube 310 through chamber 330F. As wire auger 312 of auger tube 310 is driven, toner and carrier beads running along auger path 311 are carried upward into upper region 300A and start dropping from perforations 314 located at right end 301A, as shown in FIG. 5. As toner and carrier beads build up at right end 301A, the toner and carrier beads in reservoir 301 slope upward from lower region 300B toward the perforations 314 at right end 301A and so form an incline 405 that is substantially equal to the second height of housing 300 (at left end 301B).

Meanwhile, residual toner transported via auger 274 from ITM 250 enters housing 300 through toner inlet 302E. Toner inlet 302E is in fluid communication with auger tube 304 at upper region 300A in right end 301A and so drops the residual toner to auger tube 304. Driven wire auger 306D of auger tube 304 then moves the toner falling from toner inlet 302E along auger path 305A toward left end 301B, as indicated by arrows 88 in FIGS. 3 and 4. Moving toner then falls out of perforations 402 starting from right end 301A toward the center of housing 300, as shown in FIG. 5.

In FIG. 6, as toner and carrier beads continue to drop from perforations 314, 402 and build up in reservoir 301, the toner and carrier beads therein now form an incline 406 that substantially slopes upward from right end 301A and then downward toward the center of housing 300, contacting the bottom surface 310B of auger tube 310 along the first height of housing 300 (at right end 301A). The incline 406 follows the concave bottom surface 310B, thereby substantially filling up reservoir 301 with toner and carrier beads from its right end 301A toward the center, as shown in FIG. 6. At the same time, moving toner along the driven wire auger 306D starts falling from the center of housing 300 toward left end 301B of reservoir 301 such that a slope 407 of toner and carrier beads which have fallen from perforations 314, 402 extends from incline 406 toward drive assembly 320, filling up substantially half of the entire reservoir 301.

Thereafter, driven wire augers 312 and 306D continue to move toner and carrier beads so as to fall through perforations 314 and 402, respectively, from the center of housing 300 to left end 301B, thereby completely filling up the entire reservoir 301, as shown in FIG. 7. The relatively uniform distribution of toner and carrier beads in reservoir allows a toner level sensor of waste toner bottle 266 to more accurately determine when reservoir 301 is full. In one embodiment, the sensing scheme uses capacitive level sensing that measures the capacitance across waste toner bottle 266 to determine when it is completely filled. In another embodiment, a mechanical or optical sensor inside waste toner bottle 266 may be actuated by toner and carrier beads when these completely fill the waste toner bottle 266.

Figure 8:
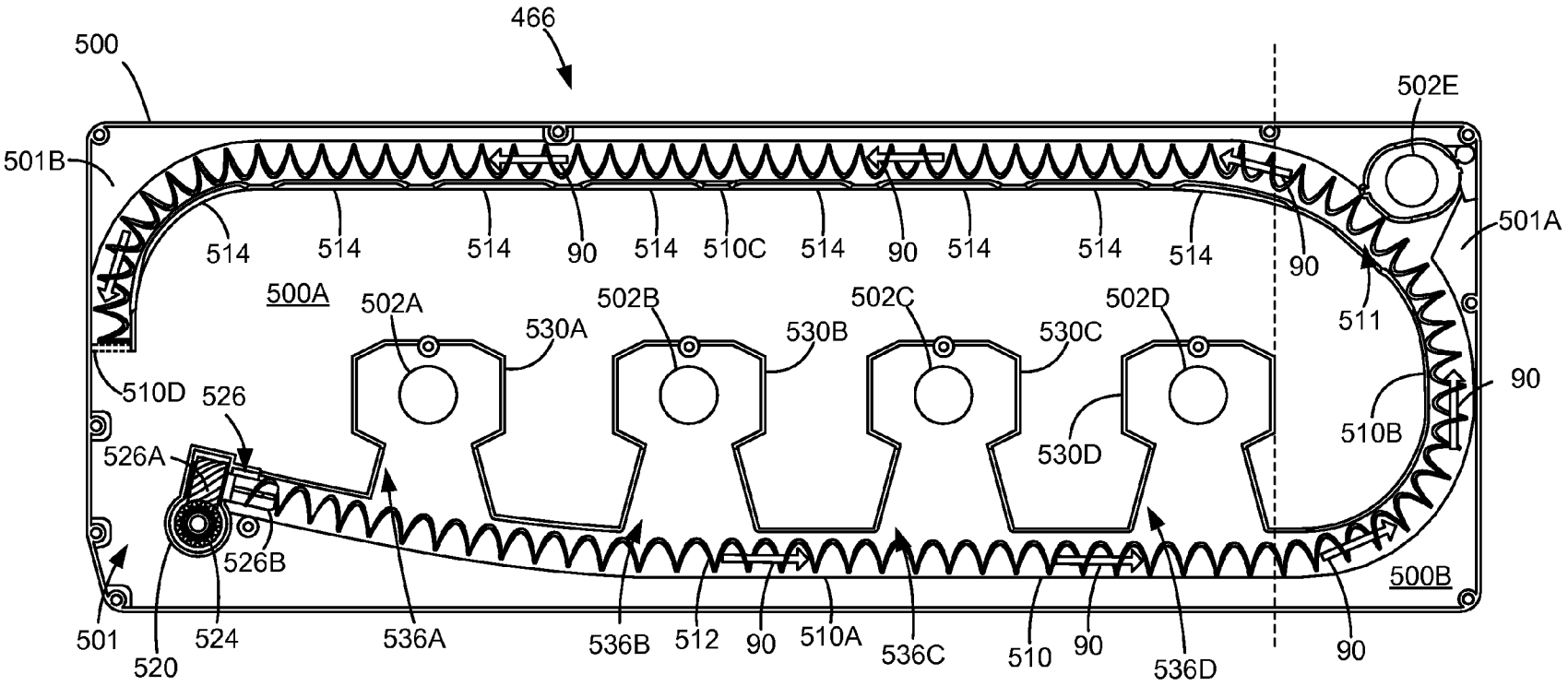
FIG. 8 is a side cross-sectional view of a waste toner bottle of an image forming device and having a residual toner delivery mechanism according to another example embodiment.

FIG. 8 illustrates a side cross-sectional view of a waste toner bottle 466 according to another example embodiment employing a residual toner delivery mechanism. The waste toner bottle 466 also includes a housing 500, a reservoir 501 and toner inlets 502A, 502B, 502C, 502D, 502E disposed therein as well as chambers 530A, 530B, 530C, 530D which enclose the toner inlets 502A, 502B, 502C, 502D, respectively. In this embodiment, the housing 500 has a height substantially the same across the entire length thereof from a right end 501A to a left end 501B of reservoir 501 for storing residual toner from the image forming device. Housing 500 may also include carrier bead inlets where a dual component development system is used as discussed above.

Waste toner bottle 466 includes an auger tube 510 that is disposed within reservoir 501 and positioned about housing 500 to extend along the entire length thereof. As shown in FIG. 8, one end of the auger tube 510 is adjacent to a drive assembly 520 positioned upstream from chamber 530A of toner inlet 502A. Auger tube 510 has a bottommost region 510A along a substantially horizontal path disposed below and substantially parallel to a horizontal line connecting toner inlets 502A, 502B, 502C, 502D for receiving residual toner dropped therefrom. Auger tube 510 also has a loop region 510B in a direction counterclockwise as viewed in FIG. 8, connected at one end (starting at the right edge of chamber 530D) to the bottommost region 510A and at an opposed end to an upper horizontal run 510C of auger tube 510. Auger tube 510 thus forms a substantially O-shape that starts from the left end 501B near toner inlet 502A, moves along the substantially horizontal path, loops along the loop region 510B (in a counterclockwise direction as viewed) then runs horizontally toward left end 501B. As the horizontal run 510C of auger tube 510 approaches the edge of left end 501B of reservoir 501, auger tube 510 loops to terminate at its outlet 510D, pointing to the bottom of housing 500 and thereby enclosing toner inlets 502A, 502B, 502C, 502D in the substantially O-shape of auger tube 510. The toner inlet 502E is disposed in upper region 500A at the right end 501A, near the top of housing 500 for toner to enter auger tube 510 from ITM 250 via auger 274.

Auger tube 510 is a hollow tube that defines an auger path 511 to provide a path for residual toner to move about housing 500. Auger tube 510 also includes a wire auger 512 disposed along the auger path 511 to transport residual toner about housing 500. The wire auger 512 is flexible for looping around the substantially O-shape of auger tube 510. In this embodiment, the entire wire auger 512 may be a single wire auger segment driven in one direction along the continuous auger path 511 by the drive assembly 520. In particular, drive assembly 520 includes a drive member 526 coupled to one end of wire auger 512 to provide rotational power for transporting toner. The drive member 526 can be driven by any suitable drive mechanism, such as a rotating member 524. Rotating member 524 is coupled to a gear 526A mounted on drive member 526 and receives the rotational power directly or indirectly from a motor (not shown) to rotate the gear 526A. As drive member 526 rotates, wire auger 512 receives rotational power therefrom and thereby transports toner. Drive member 526 also has a plurality of ribs 526B that mount one end of wire auger 512 on drive member 526.

Auger tube 510 includes a plurality of perforations 514 along a bottom surface of horizontal run 510C in upper region 500A. The perforations 514 start from right end 501A and extend toward left end 501B adjacent to the outlet 510D. Perforations 514 are also sized to allow moving toner to exit from auger tube 510 into reservoir 501 via gravity. In particular, the exiting toner starts falling into reservoir 501 at a position substantially adjacent to chamber 530D at a position shown in FIG. 8 by a dashed vertical line. Exiting toner continues falling through perforations 514 as toner moves toward the center of housing 500 along the horizontal run of auger tube 510, then continues to move to left end 501A as toner fills up reservoir 501 and thereafter exits at outlet 510D when reservoir 501 is substantially filled up.

In operating waste toner bottle 466, toner inlets 502 receive residual toner from the image forming device. In particular, residual toner transported from photoconductive drums 201A, 201B, 201C and 201D enters housing 500 through toner inlets 502A, 502B, 502C and 502D, respectively, using augers 264 of corresponding cleaner units 230. As toner falls from the corresponding chambers 530A, 530B, 530C, 530D via outlets 536A, 536B, 536C, 536D to portions of auger tube 510, driven wire auger 512 moves the toner toward perforations 514 and outlet 510D. As indicated by arrows 90, wire auger 512 moves toner falling along its length (from corresponding outlets 536A, 536B, 536C, 536D of chambers 530A, 530B, 530C, 530D) upwardly in a counterclockwise direction as viewed in FIG. 8. When wire auger 512 moves toner vertically upward along auger path 511 near right end 501A, toner tends to fill auger tube 510. The horizontal run of auger tube 510 at lower region 500B approaching the point where toner is carried upward (in a counterclockwise direction as viewed in FIG. 8) prevents auger tube 510 from clogging with toner. As wire auger 512 moves toner upward, toner reaches perforations 514 and falls into reservoir 501 from right end 501A to left end 501B. Meanwhile, a portion of wire auger 512 in upper region 500A at right end 501A moves toner falling from toner inlet 502E along auger path 511 toward left end 501B to also fall into reservoir 501 through perforations 514 in the same manner. This redistributes residual toner evenly within reservoir 501 from right to left as viewed in FIG. 8 using a single auger tube 510.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A waste toner bottle for an imaging device, comprising:

a housing having a reservoir for storing toner, the reservoir having an upper region and a plurality of inlets into the reservoir to receive toner from the imaging device; and a tube positioned within the reservoir defining an auger path about the housing, the tube in fluid communication with the plurality of inlets and having a transfer auger disposed along the auger path to distribute the toner received from the imaging device in the reservoir, the tube extending from a position below the plurality of inlets upward into the upper region of the reservoir above the plurality of inlets to move the toner received from the imaging device into the upper region of the reservoir, wherein the tube extends from a first end of the reservoir to a second end of the reservoir in the upper region of the reservoir and the tube includes perforations in a bottom of the tube between the first end of the reservoir and the second end of the reservoir in the upper region of the reservoir to drop toner from the tube into the reservoir.

2. The waste toner bottle of claim 1, wherein the tube substantially encircles the plurality of inlets.

3. The waste toner bottle of claim 1, wherein a portion of the tube extends vertically upward into the upper region of the reservoir.

4. The waste toner bottle of claim 3, wherein the tube includes a substantially horizontal segment disposed below the plurality of inlets leading to the portion of the tube that extends vertically upward into the upper region of the reservoir.

5. The waste toner bottle of claim 1, further comprising a plurality of chambers, each of the plurality of chambers enclosing a corresponding inlet of the plurality of inlets, wherein each chamber includes an outlet in fluid communication with the tube and the outlet has an upstream opening that is smaller than a downstream opening of the outlet that exits the toner from the outlet.

6. The waste toner bottle of claim 5, wherein an angle formed from the upstream opening of each outlet to the downstream opening of said outlet is at least 30 degrees.

7. A waste toner bottle for an imaging device, comprising:

a housing having a reservoir for storing toner, the housing having an upper region and a plurality of inlets to receive toner from the imaging device;

a first tube defining a first auger path disposed about the housing, the first tube in fluid communication with the plurality of inlets and having a first transfer auger disposed along the first auger path to move toner received from the plurality of inlets to an outlet of the first tube; and a second tube having an inlet disposed below the outlet of the first tube and in fluid communication therewith for receiving toner from the first tube via gravity, the second tube having a second auger path about the housing and a second transfer auger disposed along the second auger path to move the toner received from the first tube into the reservoir, the second tube extending upward into the upper region of the housing above the plurality of inlets to move the toner received from the first tube into the upper region of the housing, wherein the second tube extends from a first end of the reservoir to a second end of the reservoir in the upper region of the housing and the second tube includes perforations in a bottom of the second tube between the first end of the reservoir and the second end of the reservoir in the upper region of the housing to drop toner from the second auger path into the reservoir.

8. The waste toner bottle of claim 7, wherein the first tube and the second tube substantially encircle the plurality of inlets.

9. The waste toner bottle of claim 7, wherein a portion of the second tube extends vertically upward into the upper region of the housing.

10. The waste toner bottle of claim 9, wherein the second tube includes a substantially horizontal segment disposed below the plurality of inlets leading to the portion of the second tube that extends vertically upward into the upper region of the housing.

11. The waste toner bottle of claim 7, further comprising a plurality of chambers, each of the plurality of chambers enclosing a corresponding inlet of the plurality of inlets, wherein each chamber includes an outlet in fluid communication with the first tube and the outlet of each chamber has an upstream opening that is smaller than a downstream opening of the outlet of the chamber that exits the toner from the outlet of the chamber to the first tube.

12. The waste toner bottle of claim 11, wherein an angle formed from the upstream opening of the outlet of each chamber to the downstream opening of the outlet of the chamber is at least 30 degrees.

13. The waste toner bottle of claim 7, wherein the first transfer auger includes a first segment and a second segment, the first segment of the first transfer auger positioned to move toner in the first tube received from a first of the plurality of inlets away from the first end of the reservoir and the second segment of the first transfer auger positioned to move toner in the first tube received from a second of the plurality of inlets away from the second end of the reservoir such that toner in the first tube received from the first of the plurality of inlets and toner in the first tube received from the second of the plurality of inlets converge at the outlet of the first tube.

14. A method for evenly distributing toner in a waste toner bottle of an imaging device, the waste toner bottle having a housing and an auger for moving toner thereabout and the housing having an upper region, a plurality of inlets for receiving toner from the imaging device and a reservoir for storing toner, the method comprising:

receiving toner from the plurality of inlets;

directing the received toner to the auger;

moving the directed toner upward to the upper region of the housing above the plurality of inlets; and dropping the toner by gravity from the auger in the upper region of the housing into the reservoir beginning at a first end of the reservoir and extending to a second end of the reservoir to fill the reservoir with toner from the first end to the second end, wherein the moving the directed toner upward to the upper region above the plurality of inlets includes moving the directed toner vertically upward along the first end of the reservoir, further comprising moving the directed toner along a substantially horizontal path leading to a point where the directed toner is moved vertically upward along the first end of the reservoir.

15. The method of claim 14, further comprising moving the directed toner along a path that substantially encircles the plurality of inlets.

16. A method for evenly distributing toner in a waste toner bottle of an imaging device, the waste toner bottle including a housing having an upper region, a plurality of inlets for receiving toner from the imaging device and a reservoir for storing toner, the waste toner bottle including first and second auger tubes disposed in the housing, the method comprising:

receiving toner from the plurality of inlets;

directing the received toner to the first auger tube;

transferring by gravity the directed toner from an outlet of the first auger tube to an inlet of the second auger tube;

moving the transferred toner in the second auger tube upward to the upper region of the housing above the plurality of inlets; and dropping the toner by gravity from the second auger tube in the upper region of the housing into the reservoir beginning at a first end of the reservoir and extending to a second end of the reservoir to fill the reservoir with toner from the first end to the second end.

17. The method of claim 16, further comprising moving the received toner from a first of the plurality of inlets in the first auger tube away from the first end of the reservoir and moving the received toner from a second of the plurality of inlets in the first auger tube away from the second end of the reservoir such that the received toner from the first of the plurality of inlets and the received toner from the second of the plurality of inlets converge into the outlet of the first auger tube.

18. The method of claim 16, wherein the moving the transferred toner in the second auger tube upward to the upper region of the housing above the plurality of inlets includes moving the transferred toner in the second auger tube vertically upward along the first end of the reservoir.

19. The method of claim 18, further comprising moving the transferred toner along a substantially horizontal path leading to a point where the transferred toner is moved in the second auger tube vertically upward along the first end of the reservoir.

20. The method of claim 16, further comprising moving the transferred toner along a path that substantially encircles the plurality of inlets.

21. A waste toner bottle for an imaging device, comprising:

a housing having a reservoir for storing toner, the housing having an upper region and a plurality of inlets to receive toner from the imaging device; and a tube defining an auger path disposed about the housing, the tube in fluid communication with the plurality of inlets and having a transfer auger disposed along the auger path to move the toner received from the imaging device into the reservoir, the tube extending upward into the upper region of the housing above the plurality of inlets to move the toner received from the imaging device into the upper region of the housing, wherein the tube extends from a first end of the reservoir to a second end of the reservoir in the upper region of the housing and the tube includes perforations in a bottom of the tube between the first end of the reservoir and the second end of the reservoir in the upper region of the housing to drop toner from the auger path into the reservoir, wherein a portion of the tube extends vertically upward into the upper region of the housing, wherein the tube includes a substantially horizontal segment disposed below the plurality of inlets leading to the portion of the tube that extends vertically upward into the upper region of the housing.

22. A waste toner bottle for an imaging device, comprising:

a housing having a reservoir for storing toner, the housing having an upper region and a plurality of inlets to receive toner from the imaging device;

a tube defining an auger path disposed about the housing, the tube in fluid communication with the plurality of inlets and having a transfer auger disposed along the auger path to move the toner received from the imaging device into the reservoir, the tube extending upward into the upper region of the housing above the plurality of inlets to move the toner received from the imaging device into the upper region of the housing; and a plurality of chambers, each of the plurality of chambers enclosing a corresponding inlet of the plurality of inlets, wherein each chamber includes an outlet in fluid communication with the tube and the outlet has an upstream opening that is smaller than a downstream opening of the outlet that exits the toner from the outlet, wherein the tube extends from a first end of the reservoir to a second end of the reservoir in the upper region of the housing and the tube includes perforations in a bottom of the tube between the first end of the reservoir and the second end of the reservoir in the upper region of the housing to drop toner from the auger path into the reservoir.

* * * * *